United States Patent [19]

Barford et al.

[11] Patent Number: 4,738,728

[45] Date of Patent: Apr. 19, 1988

[54] LAVATORY CLEANSING BLOCKS CONTAINING POLYVALENT METAL SALTS TO CONTROL IN-USE BLOCK LIFE

[75] Inventors: Eric D. Barford, Stanton; Peter J. Clark, Bury St. Edmunds, both of England

[73] Assignee: Jeyes Group Limited, Norfolk, England

[21] Appl. No.: 803,227

[22] Filed: Dec. 2, 1985

[30] Foreign Application Priority Data

Nov. 30, 1984 [GB] United Kingdom ..... 8430249

[51] Int. Cl.[4] ..... C11D 1/12; C11D 3/04; C11D 17/00; E03D 9/02

[52] U.S. Cl. ..... 134/34; 4/227; 4/228; 134/42; 239/34; 252/89.1; 252/90; 252/106; 252/133; 252/134; 252/174; 252/174.11; 252/174.21; 252/548; 252/550; 252/554; 252/558

[58] Field of Search ..... 252/90, 92, 133, 134, 252/89.1, 174, 174.21, 550, 554, 558, DIG. 16, 106, 548; 134/34, 42; 4/227, 228; 239/34

[56] References Cited

U.S. PATENT DOCUMENTS

| | | | |
|---|---|---|---|
| 4,269,723 | 5/1981 | Barford | 252/106 |
| 4,396,522 | 8/1983 | Callicott | 252/163 |
| 4,477,363 | 10/1984 | Wong | 252/134 |
| 4,534,879 | 8/1985 | Iding | 252/174 |

*Primary Examiner*—Dennis Albrecht

*Attorney, Agent, or Firm*—Stevens, Davis, Miller & Mosher

[57] ABSTRACT

A lavatory cleansing block is formed of a mixture comprising:

(a) from 5 to 85% by weight of one or more anionic surface active agents;

(b) from 2 to 50% by weight of one or more solubility control agents having a solubility in water less than that of the anionic surface active agent(s); and (c) from 0.5 to 50% by weight of one or more water-soluble salts of polyvalent metals.

6 Claims, No Drawings

LAVATORY CLEANSING BLOCKS CONTAINING POLYVALENT METAL SALTS TO CONTROL IN-USE BLOCK LIFE

This invention is concerned with improvements in and relating to lavatory cleansing blocks.

In particular, the present invention is concerned with so-called "free standing" lavatory cleansing blocks which are immersed in the water cistern of a lavatory or urinal so that cleansing ingredients contained in the block are slowly dissolved in the water of the cistern. On flushing of the lavatory or urinal, the water from the cistern, containing dissolved cleansing ingredients, is flushed into the lavatory bowl or urinal and serves to cleanse it.

Generally such lavatory cleansing block comprise two principal components namely:

(i) a surface active or detergent component comprising one or more surface active or detergent agents, and (ii) a solubility retardant or solubility control component, which serves to control the rate of dissolution of the block in the water of the cistern and comprises one or more, more or less water-insoluble components.

In addition to these two principal components, free standing lavatory cleansing blocks commonly contain one or more of inert fillers, water-softening agents (which may also serve to some extent as fillers), colouring agents (especially water-soluble dyestuffs, commonly of a blue or green colour), perfumes and germicides or preservatives.

One class of surface active agent which has been proposed for use in lavatory cleansing blocks is that comprising anionic surface active agents, typically alkali metal alkyl aryl sulphonates or paraffin sulphonates, especially the former. We have found that lavatory cleansing blocks containing anionic surface active agents suffer from the disadvantage that their in-use lives, all other things being equal, vary markedly depending upon the hardness of the water supplied to the cistern. Thus, the in-use life is generally greater when the water is hard and vice versa. In practice, we have found that the in-use life in hard water may be more than 50% greater than that in soft water.

It has now been found, in accordance with the present invention, that this problem of variable in-use life in hard or soft water may be overcome by incorporating in the block a water-soluble salt of a polyvalent metal.

According to the invention, therefore, there is provided a lavatory cleansing block, for immersion in the cistern of a lavatory, formed of a composition comprising:

(a) from 5 to 85% by weight of one or more anionic surface active agents;

(b) from 2 to 50% by weight of one or more solubility control agents having a solubility in water less than that of the anionic surface active agent(s); and (c) from 0.5 to 50% by weight of one or more water-soluble salts of polyvalent metals;

together with a balance, if any, comprising one or more of inert fillers, water-softening agents, colouring agents, perfumes, germicides and lime scale-removing agents.

The anionic surface active agent used in the blocks of the present invention may be, for example, an alkali metal, typically sodium, paraffin sulphonate; alkali metal alkyl sulphate or alkali metal alkyl aryl sulphonate; especially an alkali metal alkyl benzene sulphonate. In particular, sodium dodecyl benzene sulphonate may be mentioned as it is a readily commercially available anionic surface active agent.

The anionic surface active component of the block should form from 5 to 85% by weight, preferably from 15 to 60% by weight, more preferably from 20 to 50% by weight of the block.

In addition to the anionic surface active agent component, other surface active or detergent materials may be present in the block, especially nonionic surface active materials. Such materials should preferably be present in lesser amounts than the anionic surface active agent and thus may, for example, form from 1 to 25%; preferably from 5 to 20%, by weight of the block. However, such materials may be present in greater amounts when, as discussed below, they also serve as solubility control agents.

Typical nonionic surface active agents which may be employed include polyalkoxylated, usually polyethoxylated, fatty acids, fatty alcohols and alkyl phenols; and ethylene oxide/propylene oxide block copolymers. As is well known, the water-solubility of such nonionic surface active agents generally varies depending upon the average amount of ethylene oxide units per mole of surfactant. Thus, for example, ethoxylated nonionic surface active agents containing an average of ten or more ethylene oxide units per mole are generally readily water-soluble whereas those containing lower amounts of ethylene oxide, especially those containing from 1 to 5 ethylene oxide units per mole, are less water-soluble and thus may serve both as surface active agents and as solubility control agents.

The solubility control agents used in the present invention are organic compounds of lower solubility than the anionic surface active agents and may vary in solubility from virtually completely insoluble to moderately soluble. As will be appreciated, a wide variety of solubility control agents may be employed and examples thereof include: waxes, such as waxes of natural origin, polyethylene waxes and amide waxes; long chain (e.g. containing more than 10 carbon atoms) fatty alcohols such as stearyl or behenyl alcohol; long chain, (e.g. containing more than 10 carbon atoms) fatty acids, such as stearic acid, and their salts; esters of long chain fatty alcohols with aliphatic carboxylic acids, such as stearyl acetate; esters of long chain fatty acids with mono or polyhydric alcohols, such as ethyl stearate or glycerol tristearate or mono-, di- or tri-glycerides of natural origin; fatty acid mono- and di-alkanolamides, such as coconut monoethanolamide; ethoxylated products of fatty acid mono- or di-ethanolamides containing low amounts, e.g. 2 to 4 units, of ethylene oxide per mole; paradichlorobenzene; or long chain aliphatic hydrocarbons of natural or synthetic origin.

The solubility control agent should be present in an amount sufficient to provide from 2 to 50% by weight of the block. In general, the amount of solubility control agent present will depend upon two principal factors, the intended life of the block and the solubility of the solubility control agent. As will be appreciated, in order to obtain longer life more solubility control agent should be present and vice versa. Similarly, more of the more soluble solubility control agents will be required to obtain the same life than of the less soluble or wholly insoluble solubility control agents. In general, it has been found that the solubility control agents preferably form from 2 to 30% by weight, more preferably from 5 to 20% by weight, of the block.

Whilst we do not wish to be limited by theoretical considerations, it is believed that the polyvalent metal salt serves to supply polyvalent metal ions in solution which imitate or mimic the action of similar ions present in hard water. Thus, preferred polyvalent metals those of groups II and III of the Periodic Table, especially, are calcium and magnesium but it will, of course, be understood that other polyvalent metals may be employed. Generally the salts will be salts of mineral acids such as sulphuric acid. Preferably the salt is one which is not deliquescent and thus a particularly preferred salt is magnesium sulphate. Whilst the polyvalent metal salts may be present in an amount of from 0.5 to 50% by weight of the block, it preferably forms from 5 to 25% by weight of the block.

In addition to the three essential ingredients noted above, namely anionic surface agent, solubility control agent and polyvalent metal salt, the blocks of the invention may contain other ingredients, especially inert fillers, water-softening agents, colouring agents, perfumes, preservatives and lime scale-removing agents.

Suitable fillers for use in the blocks of the invention are water-soluble organic fillers such as urea or water-soluble inorganic fillers such as sodium carbonate, sodium bicarbonate, sodium chloride, sodium sulphate and borax. Suitable water-softening agents include, for example, inorganic water-softening agents, such as sodium hexametaphosphate or other alkali metal polyphosphates, or organic water-softening or chelating agents such as ethylene-diamine tetraacetic acid and nitrilotriacetic acid and alkali metal salts thereof.

The inert fillers and/or water-softening agents may in total form up to 75% by weight of the block but preferably form from 5 to 50%, more preferably 5 to 40% by weight of the block.

The blocks of the invention will also generally contain a dyestuff or other colouring agent, such as a pigment, in order to impart a pleasant colouration to the water and also to indicate to the user when the block has exhausted (i.e. on exhaustion of the block the water becomes colourless). Accordingly, the block preferably contains water soluble dyestuff, suitably in an amount of up to 20% by weight, preferably in an amount of from 1 to 15% by weight, more preferably from 1 to 10% by weight. Suitable dyestuffs include, for example, Acid Blue 9, Acid Blue 1, Acid Blue 7 and Acid Yellow 23.

The blocks may also contain perfumes to impart an acceptable odour to the flushed water. The perfume may be a solid perfume, which term is intended to include micro-encapsulated perfumes (i.e. liquid perfumes contained in a water-soluble microcapsule) or other solid perfume materials such as paradichlorobenzene. Alternatively the perfume may be a liquid and in this case the term liquid perfume is intended to cover not only perfumes per se but solutions or perfumes in solvents therefor. The total amount of perfume should not be more than 35% by weight and is preferably from 2 to 20% by weight. It may be noted that the term "perfume" is intended to refer to any material giving an acceptable odour and thus materials giving a "disinfectant" odour such as pine oils, terpinolenes or paradichlorobenzene may be employed. It may be further noted that liquid perfumes are frequently substantially water-insoluble and thus they may serve as a part, or indeed all, of the water-solubility control agent. In other words, a single material, such as pine oil, may serve both as perfume and a solubility control agent.

The blocks in accordance with the invention may also contain germicides. Suitable germicides include, for example, formaldehyde release agents and chlorinated phenols. These compounds may be present in the blocks in amounts of up to 20% by weight, preferably from 0.1 to 15% by weight.

Suitable lime scale-removing agents are acidic compounds such as citric acid, sulphuric acid and phosphoric acid. These, when present, suitably form up to 40% by weight of the block, especially in the case of solid acidic materials, such as citric acid, which then also serve as a filler.

The blocks in accordance with the invention are conveniently produced by a compression process, especially an extrusion process comprising forming a mixture of the components for the block, extruding this mixture into rod or bar form and subsequently cutting the rod or bar into portions or blocks of the desired size. When employing an extrusion process it is most desirable that the starting mixture contains a liquid component or a solid component capable of being liquified under extrusion conditions, generally in an amount of from 1 to 20% by weight, preferably from 3 to 15% by weight, of the total mixture. Most conveniently such a liquid component comprises a perfume component and/or a solubility control agent component. Thus, for example, pine oil may serve not only as a perfume and solubility control agent but also as an extrusion processing aid. The blocks of the invention are suitably from 20 to 150 gms in weight preferably from 30 to 70 gms in weight.

The invention further provides a method for cleansing a lavatory or urinal which comprises immersing in the water cistern of the lavatory or urinal a block in accordance with the invention.

In order that the invention may be well well understood the following Examples are given by way of illustration only. In the Examples all parts are by weight.

EXAMPLES

Lavatory cleansing blocks were prepared by extruding compositions as detailed in the following Table and cutting the extrudate in blocks weighing 50 g.

TABLE

| Example | Anionic surfactant (parts) | Filler (sodium sulphate) parts | Polyvalent metal salt (parts) | Others (parts) |
|---|---|---|---|---|
| 1. | S.D.B.S. (50) | 27.5 | $CaCO_3$ (10) | P.O. (8) |
| 2. | S.D.B.S. (50) | 28 | $MgSO_4.7H_2O$ (2) $CaCO_2$ (7.5) | P.O. (8) |
| 3. | S.D.B.S. (50) | 0 | $CaCl_2$ (37.5) | P.O. (8) |
| 4. | S.D.B.S. (50) | 0 | $MgSO_4.7H_2O$ (37.5) | P.O. (8) |
| 5. | S.D.B.S. (50) | 0 | $MgCO_3$ (37.5) | P.O. (8) |
| 6. | S.D.B.S. (50) | 27.5 | $MgSO_4.7H_2O$ (10) | P.O. (8) |
| 7. | S.D.B.S. (50) | 33.5 | $MgCl_2$ (2) | P.O. (8) |
| 8. | S.D.B.S. (50) | 32.5 | $MgSO_4.7H_2O$ (5) | P.O. (8) |
| 9. | S.D.B.S. (50) | 31.5 | $MgSO_4.7H_2O$ (5) | P.O. (9) |
| 10. | S.D.B.S. (50) | 11.5 | $MgSO_4.7H_2O$ (25) | P.O. (9) |
| 11. | S.D.B.S. (50) | 22.5 | $MgSO_4.7H_2O$ (15) | P.O. (8) |

TABLE-continued

| Example | Anionic surfactant (parts) | Filler (sodium sulphate) parts | Polyvalent metal salt (parts) | Others (parts) | |
|---|---|---|---|---|---|
| 12. | S.D.B.S. (50) | 25.5 | $MgSO_4.7H_2O$ (10) | P.O. (10) | |
| 13. | S.D.B.S. (50) | 27.0 | $MgSO_4.7H_2O$ (10) | P.O. (10) | Na.S (0.5) |
| 14. | S.D.B.S. (50) | 26.5 | $MgSO_4.7H_2O$ (10) | P.O. (8) | Na.S (1.0) |
| 15. | S.D.B.S. (50) | 26.0 | $MgSO_4.7H_2O$ (10) | P.O. (8) | Na.S (1.5) |
| 16. | NDBS (50) | 22.585 | $MgSO_4.7H_2O$ (10) | P.O. (8) | Na.S (1) |
| 17. | NDBS (60) | 12 | $MgSO_4.7H_2O$ (10) | P.O. (9) | Na.S (2.5) |
| 18. | NDBS (50) | 29.5 | $MgSO_4.3H_2O$ (1) | P.O. (8) | Na.S (1.0) |
| 19. | NDBS (50) | 25.5 | $MgSO_4.7H_2O$ (10) | P.O. (8) | N.D.E. (2) |
| 20. | NDBS (50) | 26.5 | $ZnSO_4$ (10) | P.O. (8) | Na.S (1.0) |
| 21. | NDBS (50) SLS (20) | 26.5 | $MgSO_4.7H_2O$ (10) | P.O. (8) | Na.S (1.0) |
| 22. | NDBS (50) | 26.5 | $MgSO_4.7H_2O$ (10) | NPEO (8) | Na.S (1.0) |
| 23. | NDBS | 26.5 | $Al_2(SO_4)_3.7H_2O$ (10) | P.O. (8) | Na.S (1.0) |
| 24. | NDBS | 26.5 | $MgSO_4.7H_2O$ (10) | IBA (8) | Na.S (1.0) |
| 25. | NDBS | 26.5 | $MgSO_4.7H_2O$ (10) | Tp (8) | Na.S (1.0) |

All the compositions additionally contained:

(i) 0.5 parts of a preservative (o-benzyl-p-chlorophenol); and (ii) a dyestuff (4 parts of Acid Blue 9 except for Example 18 which contained 4.5 parts of Acid Blue 9 and 1.15 parts of Acid Yellow 23).

In the Table:

SDBS=sodium dodecyl benzene sulphonate (as Nansa H5 80 S-80% active);

P.O.=Pine oil;

Na.S=sodium stearate;

LDE=lauric diethanolamide;

SLS=sodium lauryl sulphate;

NPS=ethoxylated nonyl phenol (average 4 moles EO per mole nonyl phenol);

IBA=isobornyl aceate;

Tp=terpineol.

We claim:

1. A method of cleansing a lavatory which comprises immersing in the cistern of the lavatory a free standing block formed of a composition comprising:

(a) from 5 to 85% by weight of at least one alkali metal anionic surface active agent;

(b) from 2 to 50% by weight of at least one organic solubility control agent having a solubility in water less than that of the alkali metal anionic surface active agent; and (c) from 0.5 to 50% by weight of at least one inorganic water-soluble salt of calcium and magnesium; together with a balance, if any, of the following components: inert fillers, water-softening agents, coloring agents, perfumes, germicides and lime scale-removing agents.

2. The method of claim 1 in which the alkali metal anionic surface active agent is selected from the group consisting of alkali metal paraffin sulphonates, alkali metal alkyl sulphates and alkali metal alkyl aryl suphonates.

3. The method of claim 1 wherein (a) contains from 15 to 60% by weight of alkali metal anionic surface active agent(s).

4. The method of claim 1 wherein (a) also contains from 1 to 25% of a nonionic surface active agent.

5. The method of claim 1 wherein (b) contains from 2 to 30% by weight of an organic solubility control agent.

6. The method of claim 1 wherein (c) contains from 5 to 25% by weight of said inorganic water-soluble salt.

* * * * *